US006083084A

United States Patent [19]

Yokogawa et al.

[11] Patent Number: 6,083,084

[45] Date of Patent: Jul. 4, 2000

[54] MACHINING APPARATUS AND PROCESS USING COLD GAS STREAM, AND COLD GAS STREAM COOLING DEVICE AND METHOD FOR CENTERLESS GRINDER

[75] Inventors: Kazuhiko Yokogawa, Kawasaki; Shuji Yamamoto, Toyota; Katsuhiko Hashizume, Toyota; Masaaki Sato, Toyota; Tokufumi Takeuchi, Yamagata; Mohee Sagae, Yamagata; Masayuki Kuwata, Yamagata; Satoshi Ebina, Yamagata, all of Japan

[73] Assignee: Toyota Jidosha Kabushiki Kaisha, Toyota, Japan

[21] Appl. No.: 09/145,265

[22] Filed: Sep. 2, 1998

[30] Foreign Application Priority Data

Jan. 26, 1998 [JP] Japan ..... 10-012419

[51] Int. Cl.[7] ..... B24B 1/00; B24B 5/307

[52] U.S. Cl. ..... 451/53; 451/56; 451/72; 451/243; 451/450; 451/488

[58] Field of Search ..... 451/242, 243, 451/449, 53, 72, 450, 56, 488

[56] References Cited

U.S. PATENT DOCUMENTS

| | | | |
|---|---|---|---|
| 1,658,252 | 10/1928 | Laessker . | |
| 2,475,811 | 10/1949 | Wagner et al. . | |
| 2,794,304 | 6/1957 | Frankiewicz et al. | 451/53 |
| 3,594,953 | 7/1971 | Stade et al. . | |
| 3,696,564 | 10/1972 | Joyce . | |
| 3,712,001 | 1/1973 | Kaesemeyer et al. . | |
| 3,748,788 | 7/1973 | Koppenwallner . | |
| 3,834,088 | 9/1974 | Matson . | |
| 3,952,458 | 4/1976 | Tomita et al. . | |
| 4,314,425 | 2/1982 | Bricker et al. | 451/450 |
| 4,514,934 | 5/1985 | Ray et al. | 451/450 X |
| 4,622,780 | 11/1986 | Tingley | 451/450 X |
| 5,103,701 | 4/1992 | Lundin et al. | 451/53 X |

FOREIGN PATENT DOCUMENTS

| | | |
|---|---|---|
| 52-17293 | 2/1977 | Japan . |
| 1-153257 | 6/1989 | Japan . |
| 1-121650 | 8/1989 | Japan . |

OTHER PUBLICATIONS

Kogyo Chosakai, *Production Machining Technology for Harmonization with Environment, Cutting and Grinding Techniques Using Cold Gas for Protecting Environment, and Realization of ISO 14000; Machines and Tools*; Nov. 1, 1996.

*Primary Examiner*—Timothy V. Eley
*Attorney, Agent, or Firm*—Burns, Doane, Swecker & Mathis, LLP

[57] ABSTRACT

Machining apparatus for machining a workpiece with a machining tool, including a work holder for holding the workpiece, and a cold gas stream supply device including a cooling gas nozzle through which a cold gas stream is supplied to a machining point, and wherein the cooling gas nozzle is provided on the work holder, and the cold gas stream has a temperature lower than an ambient temperature of the apparatus. The apparatus may be a centerless grinding apparatus including a regulating wheel for rotating the workpiece, and a work rest blade cooperating with the regulating wheel to rotatably support the workpiece so that the workpiece is ground by a grinding wheel while the workpiece is held by the work holder between the regulating and grinding wheels. The cooling gas nozzle is desirably positioned such that a distance between the exit end of the cooling gas nozzle and the grinding point is not larger than a diameter of the workpiece. Also disclosed are machining process and cooling method and device using the cold gas stream.

19 Claims, 7 Drawing Sheets

MACHINING APPARATUS AND PROCESS USING COLD GAS STREAM, AND COLD GAS STREAM COOLING DEVICE AND METHOD FOR CENTERLESS GRINDER

This application is based on Japanese Patent Application No. 10-12419 filed Jan. 26, 1998, the content of which is incorporated hereinto by reference.

BACKGROUND OF THE INVENTION

1. Field of the Invention

The present invention relates in general to machining apparatus and process wherein a cold gas stream or blast is supplied to a heat-generating point or machining point such as a grinding point, and more particularly to cooling device and method using a cold gas stream.

2. Discussion of the Related Art

A machining operation on a workpiece is generally performed such that a machining tool in contact with the workpiece is moved relative to the workpiece while the workpiece is supported by suitable means. To reduce or minimize a temperature rise at the machining point due to heat generation as a result of machining of the workpiece by the machining tool, a machining apparatus is usually equipped with a cooling device.

An example of a conventional machining apparatus in the form of a centerless grinder equipped with a grinding liquid supply device is schematically illustrated in FIG. 7.

The centerless grinder includes a stationary work rest blade 1, a regulating wheel 2, and a grinding wheel 4. A workpiece 3 to be ground is interposed between the regulating and grinding wheels 2, 4. The regulating wheel 2 cooperates with the work rest blade 1 to support the workpiece 3 such that the workpiece is rotatable about its axis. In operation of the centerless grinder, the regulating wheel 2 is rotated in one direction indicated at "a" in FIG. 7, so that the workpiece 3 is rotated in a direction indicated at "b", in frictional contact with the regulating wheel 2. The portion of the workpiece 3 to be ground may have a cylindrical, tapered, conical or any other configuration having a circular shape in transverse cross section (as seen in the plane of FIG. 7).

The grinding wheel 4 is rotated in a direction indicated at "c", and is adapted to contact with the workpiece 3 at its circumferential grinding surface, so that the selected portion of the workpiece 3 is ground by the grinding wheel 4. While the circumferential position of instantaneous contact of the grinding wheel 4 with the workpiece 3 is indicated at point "g" in FIG. 5, the instantaneous contact between the grinding wheel 4 and the workpiece 3 takes place along a straight line, which extends in the axial direction of the workpiece 3 (grinding wheel 4), where the portion of the workpiece 3 to be ground is cylindrical. The length of this straight line is equal to the axial dimension of the circumferential grinding surface of the grinding wheel 4. Although the instantaneous contact is indicated by the grinding point or line "g", the contact actually occurs in some surface areas of the grinding wheel 4 and the workpiece 3 as viewed in the circumferential direction.

The rotating speeds of the regulating wheel 2 and the grinding wheel 4 are determined such that the peripheral speed of the grinding wheel 4 rotated in the direction "c" is higher than the peripheral speed of the workpiece 3 rotated by frictional contact with the regulating wheel 2 in the direction "b". Consequently, the circumferential grinding surface of the grinding wheel 4 is moved relative to the circumferential surface of the workpiece 3, whereby the portion of the workpiece 3 in contact with the grinding wheel 4 is ground. In this grinding operation, the regulating wheel 2 functions to regulate the rotating speed of the workpiece 3, while applying a certain degree of braking to the workpiece 3 rotated by frictional contact with the grinding wheel 4.

In FIG. 7, reference character "H" represents a center height of the workpiece 3 with respect to the regulating and grinding wheels 2, 4. More specifically described, the center height H is a distance between the center or axis of rotation of the workpiece 3 and the centers or axes of rotation of the regulating and grinding wheels 2, 4. To permit an intended centerless grinding operation on the workpiece 3, the center height H must be adequately adjusted. However, the optimum center height H more or less varies depending upon the various grinding conditions. In this respect, it is not easy to properly adjust the center height, and the adjustment requires a high level of knowledge and skill in the centerless grinding operation.

Qualitatively, there is a tendency that an excessively small amount of the center height H results in deteriorated roundness of the ground portion of the workpiece 3, while an excessively large amount of the center height H results in instability of the workpiece 3 resting on the work rest blade 1, causing chatter marks in the form of flower leaves to be formed on the ground surface of the workpiece 3.

For increased stability of the workpiece 3 resting on the work rest blade 1, a work holder 8 may be provided in sliding contact with the workpiece 3, as indicated by one-dot chain line in FIG. 7, such that the points of contact of the workpiece 3 with the work rest blade 1 and the work holder 8 are located on the opposite sides of the grinding point g in the circumference direction of the workpiece 3.

Grinding heat is generated at and near the grinding point g. A temperature rise at the grinding point g due to the heat generation may cause burning or cracking of the ground surface of the workpiece 3, deterioration of the grinding accuracy due to a difference in the thermal expansion coefficient, and other problems. To avoid these problems, a grinding liquid nozzle 7 is provided above the grinding point g, so that a grinding liquid pumped up from a liquid tank 5 by a pump 6 is delivered through the nozzle 7 to the grinding point g and its vicinity.

The grinding liquid, which may be called a coolant, has not only a cooling function but also lubricating and cleaning functions. Lubrication at the grinding point g is important to prevent deterioration of the surface smoothness or finish of the ground portion of the workpiece 3. Further, the grinding liquid is effective to remove particulate foreign matters such as abrasive grains derived from the grinding wheel 4, for maintaining good grinding condition at the grinding point g.

The grinding wheel 4 must have a desired shape established by a truing operation wherein high spots on the wheel are removed so as to shape the wheel as needed. Since the grinding wheel 4 becomes dull or glazed during use, the grinding wheel 4 is required to be subjected to a dressing operation wherein dull grains of the wheel are removed to expose sharp cutting edges for improving the grinding capability of the grinding wheel 4. While the truing and dressing operations have distinct original purposes, these operations cannot and need not be clearly distinguished from each other.

The truing and dressing operations are performed by a dresser 9, which may be of a rotary type as indicated in FIG.

7 by way of example, or alternatively of a rod or blade type having a dressing head at one of its opposite ends. Before a grinding operation of the centerless grinder, the dresser 9 is brought to its retracted position as indicated by arrow "e" in FIG. 7. When the truing or dressing operation is required to be performed, the dresser 9 is moved to its advanced position as indicated by arrow "f". In the truing or dressing operation, too, heat is generated. To reduce the temperature rise at the point of contact between the dresser 9 and the grinding wheel 4, another grinding liquid nozzle 11 is disposed near the truing or dressing point of the grinding wheel 4, so that the grinding liquid is delivered to the truing or dressing point, as indicated at "h". To this end, the conduit between the pump 6 and the nozzle 11 is provided with a switch valve 10 for delivering the grinding liquid selectively to the grinding point g and the truing or dressing point.

The conventional centerless grinding apparatus equipped with the grinding liquid supply device as shown in FIG. 7 is capable of grinding the selected portion (e.g., roughly finished portion) of the workpiece 3 with high accuracy and efficiency. However, the grinding liquid supply device requires recirculating means for returning the used liquid back to the tank 5, for recirculation of the liquid, and also requires filtering means for cleaning the liquid and removing the metal particles and abrasive grains contained in the liquid. The recirculating and filtering means increase the cost of manufacture of the liquid supply device and the cost of operation of the centerless grinding apparatus.

The grinding liquid supply device suffers from another drawback that the grinding liquid is consumed and must be replenished from time to time, leading to a further increase in the cost of operation of the centerless grinding apparatus.

In the light of the above drawbacks, one of the present co-inventors et al. has proposed the use of a cold air cooling technique as disclosed in an article entitled "PRODUCTION MACHINING TECHNOLOGY FOR HARMONIZATION WITH ENVIRONMENT, Cutting and Grinding Techniques Using Cold Gas for Protecting Environment, and Realization of ISO 1400", journal entitled "MACHINES AND TOOLS" published Nov. 1, 1996 by Kogyo Chosakai, Tokyo, Japan. The cold gas cooling technique disclosed in this article uses a stream or blast of a cold gas whose temperature is about −30° C. In this technique, it is desired to consider the following aspects:

(a) relationship between the temperature and amount of a cold air stream and the cooling capacity;

(b) relationship between the temperature at the grinding point and the burning and cracking of the ground surface (mainly in the field of material science); and (c) relationship between the material of the grinding wheel and the amount of heat generation and temperature rise.

Although the cold air cooling technique has an advantage of eliminating the need of using a machining liquid such as a grinding liquid, the present inventors felt a need of improving the cold gas cooling efficiency, without increasing the structural complexity of the machining apparatus.

SUMMARY OF THE INVENTION

It is therefore a first object of the present invention to provide a machining apparatus including a cold gas stream cooling device which satisfies the above-indicated need.

A second object of this invention is to provide a machining process including a cold gas stream cooling step which satisfies the above-indicated need.

A third object of the invention is to provide a method of cooling using a cold gas stream in a centerless grinding operation, which method satisfies the above-indicated need.

It is a fourth object of the present invention to provide a cold gas stream cooling device for a centerless grinding apparatus, which device satisfies the above-indicated need.

The first object indicated above may be achieved according to a first aspect of this invention, which provides a machining apparatus for machining a workpiece with a machining tool, comprising: (a) a work holder for holding the workpiece; and (b) a cold gas stream supply device including a cooling gas nozzle through which a cold gas stream is supplied to a machining point for cooling at the machining point, and wherein the cooling gas nozzle is provided on the work holder, and the cold gas stream has a temperature lower than an ambient temperature of the machining apparatus.

In the machining apparatus constructed according to the first aspect of this invention wherein the cooling gas nozzle is provided on the work holder, the cooling gas nozzle is held at a predetermined position relative to the workpiece, so that the cold gas stream such as a cold air stream can be supplied to the machining point with improved stability, without an insufficient or excessive amount of supply of the cold gas stream to the machining point. The work holder for holding the workpiece also functions as the cooling gas nozzle, or alternatively the cooling gas nozzle is fixed to the work holder so as to provide an assembly. Accordingly, the machining apparatus is simplified in construction, with a reduced number of components. Further, the present arrangement permits the cold gas stream to be easily delivered to the machining point between the workpiece and the machining tool, through a relatively narrow space partially defined by the workpiece and the machining tool such as a grinding wheel.

The machining apparatus may be a centerless grinding apparatus comprising a regulating wheel for rotating the workpiece, and a work rest blade which is disposed between the regulating wheel and a grinding wheel as the machining tool. In this case, the work rest blade cooperates with the regulating wheel to support the workpiece such that the workpiece is rotated by frictional contact with the regulating wheel, and the grinding wheel is rotated in contact with the workpiece to grind the workpiece. In this centerless grinding apparatus, the work holder is interposed between the regulating wheel and the grinding wheel and is located on one of opposite sides of the workpiece remote from the work rest blade so that the cold gas stream is delivered from the cooling gas nozzle toward a grinding point between the grinding wheel and the workpiece.

The first object may also be achieved according to a second aspect of this invention, which provides a machining apparatus for machining a workpiece with a machining tool, comprising a cold gas stream supply device including a cooling gas nozzle having an exit end from which a cold gas stream is supplied to a machining point between the machining tool and the workpiece, for cooling at the machining point, and wherein the cold gas stream has a temperature lower than an ambient temperature of the machining apparatus, and the exit end is located at a distance of not larger than a diameter of the workpiece, from the machining point.

In the machining apparatus constructed according to the second aspect of the invention, the distance between the exit end of the cooling gas nozzle and the machining point (e.g., grinding point) is equal to or smaller than the diameter of the workpiece to be ground. This arrangement permits the exist end of the cooling gas nozzle to be positioned relatively close to the machining point, so that the working and the machining tool can be effectively cooled by the cold gas stream, so as to reduce the amount of heat generated at the machining point.

The second object indicated above may be achieved according to a third aspect of this invention, which provides a process of machining a workpiece with a machining tool while the workpiece is held by a work holder, comprising the steps of: (a) providing the work holder with a cooling gas nozzle; and (b) supplying a cold gas stream to a machining point between the machining tool and the workpiece, through the cooling gas nozzle, for cooling at the machining point, the cold gas stream having a temperature lower than an ambient temperature.

Since the cooling gas nozzle is provided on the work holder which has a predetermined positional relationship with respect to the workpiece, the cooling gas nozzle can be held at a predetermined position relative to the workpiece, so that the cold gas stream can be supplied from the cooling gas nozzle to the machining point, with high stability.

Further, the present machining process does not require an exclusive cooling gas nozzle member, leading to structural simplification of a cold gas stream cooling device in which the cooling gas nozzle may be incorporated in the work holder. In addition, the cooling gas nozzle can be easily located adjacent to the workpiece, since the nozzle is provided on the work holder disposed adjacent to the workpiece for holding the workpiece. Thus, the cold gas stream can be easily delivered to the machining point through a relative narrow space which is partially defined by the workpiece and the machining tool.

The third object may also be achieved according to a fourth aspect of this invention, which provides a method of cooling in a centerless grinding apparatus wherein a workpiece is ground in contact with a grinding wheel while the workpiece is rotated by frictional contact with a regulating wheel and supported by the regulating wheel and a work rest blade and while the workpiece is held by a work holder for increased grinding stability, the method comprising the steps of: (a) providing the work holder with a cooling gas nozzle; (b) positioning the work holder such that an exist end of the cooling gas nozzle is located adjacent to a grinding point between the workpiece and the grinding wheel, and such that the work holder and the cooling gas nozzle are prevented from contacting with the grinding wheel; and (c) supplying a cold gas stream to the grinding point through the cooling gas nozzle, the cold gas stream having a temperature lower than an ambient temperature of the centerless grinding apparatus.

In the cooling method according to the fourth aspect of the invention, the cold gas stream can be easily supplied to the grinding point through the cooling gas nozzle provided on the work holder which is positioned such that the exit end of the nozzle is located adjacent to the grinding point, and so as to prevent the work holder and the nozzle from contacting with the rotated grinding wheel. Since the cooling gas nozzle is provided on the work holder, the cooling gas nozzle can be easily positioned adjacent to the workpiece, by positioning the work holder relative to the workpiece so as to hold the workpiece.

Described more specifically, the work holder is positioned for substantial contact with the workpiece, while avoiding a contact or interference with the grinding wheel. With the work holder thus positioned, the cooling gas nozzle is automatically positioned relative to the workpiece, without a contact with the grinding wheel.

Since the cooling gas nozzle can be positioned adjacent to the workpiece without a risk of contact with the grinding wheel, the cold gas stream can be supplied to the grinding point with high efficiency, without scattering of the cold gas, so as to expose only the grinding point and its vicinity to a sufficiently large volume of the cold gas per unit area.

Further, field adjustment of the position of the work holder relative to the workpiece results in automatic adjustment of the position of the cooling gas nozzle relative to the workpiece, whereby the adjustment or maintenance procedure of the centerless grinding apparatus can be simplified.

The cooling gas nozzle may be incorporated in the work holder such that a cooling gas passage is formed through the one-piece body of the work holder. Alternatively, the cooling gas nozzle may be fixed to the work holder so that the nozzle and the work holder constitute an assembly. Accordingly, the required number of the components of the centerless grinding apparatus is reduced, and the assembling procedure can be simplified, without use of an exclusive cooling gas nozzle separate from the work holder.

The third object indicated above may also be achieved according to a fifth aspect of this invention, which provides a method of cooling in a centerless grinding apparatus wherein a workpiece is ground in contact with a grinding wheel while the workpiece is rotated by frictional contact with a regulating wheel and supported by the regulating wheel and a work rest blade, the method comprising the steps of: (a) positioning a cooling gas nozzle having an exit end, such that a distance between the exit end and a grinding point between the workpiece and the grinding wheel is held within a range defined by an upper limit which is not larger than a diameter of the workpiece, and a lower limit above which the cooling gas nozzle is prevented from contacting with the workpiece, even in the presence of dimensional and positioning errors of the grinding wheel and the cooling gas nozzle and vibrations of the grinding wheel and the cooling gas nozzle during a grinding operation on the workpiece; and (b) supplying a cold gas stream to the grinding point through the cooling gas nozzle, said cold gas stream having a temperature lower than than an ambient temperature of the centerless grinding apparatus.

In the cooling method according to the fifth aspect of the invention, the cold gas stream can be supplied from the exit end of the cooling gas nozzle to the grinding point with high efficiency, so as to effectively cool the workpiece and the grinding wheel at the grinding point.

The cooling effect by the cold gas stream is increased with a decrease in the distance between the exit end of the cooling gas nozzle and the grinding point. However, the distance does not cause a contact or interference of the nozzle with the grinding wheel. On the other hand, it was found that an intended cooling effect cannot be obtained if the distance exceeds a value equal to the diameter of the workpiece to be ground. Conventionally, the cooling efficiency is considered to depend on the diameter of the nozzle, the pressure of the cold gas delivered from the exit end of the nozzle, and the distance between the exit end and the grinding point, and the highest value of the cooling efficiency is found by simulation wherein the values of the above-indicated three parameters are changed. However, the conventional analysis does not take account of the diameter of the workpiece to be ground.

The present inventors found that the upper limit of the distance between the exit end of the cooling gas nozzle and the grinding point is desirably not larger than the diameter of the workpiece. In the cooling method according to the fifth aspect of this invention, the distance indicated above (more precisely, the upper limit of the distance) is determined depending upon the diameter of the workpiece, so as to assure a sufficient cooling effect by the cold gas stream delivered from the cooling gas nozzle.

In a first preferred form of the cooling method according to the fourth or fifth aspect of this invention, the method further comprises the step of supplying a lubricant oil to the grinding point through a lubricant nozzle which is positioned such that the lubricant oil delivered from an exit end of the lubricant nozzle is directed toward the grinding point.

The lubricant oil delivered to the grinding point is effective to prevent or minimize burning or cracking of the ground surface of the workpiece, thereby assuring excellent finish or smoothness of the ground surface.

Described in detail, the supply of the lubricant oil as well as the cold gas stream to the grinding point provides an unexpected effect in assuring an improved surface finish of the ground portion of the workpiece. The cold gas stream provides a cooling effect equivalent to that provided by a conventionally used grinding liquid. On the other hand, the lubricant oil provides an excellent lubricating effect not provided by the cold gas stream, making it possible to prevent burning or cracking of the ground surface of the workpiece, which may take place depending upon the composition of the workpiece and other grinding conditions on the centerless grinding apparatus, in the absence of the conventionally used grinding liquid or the lubricant oil. The use of the lubricant oil is also effective to prevent rusting of the metallic components of the centerless grinding apparatus.

In a second preferred form of the cooling method according to the fourth or fifth aspect of the invention, the cooling method further comprises the step of injecting a lubricant oil into the cold gas stream in the cooling gas nozzle, so as to spray a mist of the lubricant oil toward the grinding point.

In the above second preferred form of the cooling method, a separate lubricant nozzle is not required in addition to the cooling gas nozzle. That is, the lubricant nozzle may be incorporated in the cooling gas nozzle such that the lubricant oil is injected into the cold gas passage in the cooling gas nozzle, so that a mist of the lubricant oil is generated by the stream of the cold gas flowing through the cold gas passage.

The present cooling method adapted to provide the mist of the lubricant oil according to the second preferred form described above has substantially the same advantages as the cooling method in which the lubricant nozzle separate from the cooling gas nozzle is provided according to the first preferred form of the cooling method described above.

The elimination of the separate lubricant nozzle results in reduction in the required number of the stationary members positioned adjacent to the workpiece and the grinding wheel. Accordingly, the freedom of design of the components of the centerless grinding apparatus is increased, leading to easy prevention of an interference between the stationary components (e.g., work holder and cooling gas nozzle) and the rotating components (e.g., grinding wheel and regulating wheel).

The mist of the lubricant oil consisting of fine oil particles generated by injecting the lubricant oil into the stream of the cold gas is delivered to the grinding point while being carried by the cold gas stream, so that the workpiece and the grinding wheel are coated with films of the lubricant oil, which serve to lubricate the workpiece and the grinding wheel and prevent rusting of the metallic components or the metallic parts of the components.

In a third preferred form of the cooling method according to the fourth or fifth aspect of the invention, the cooling method further comprises the step of supplying the cold gas stream to a point of contact between the grinding wheel and a dresser, to reduce an amount of heat generated at the point of contact when the grinding wheel is subjected to at least one of a truing operation and a dressing operation by the dresser.

In this third preferred form of the cooling method, the cold gas stream is used for both the grinding point between the workpiece and the grinding wheel, and the point of contact between the grinding wheel and the dresser for truing and/or dressing the grinding wheel. Accordingly, the centerless grinding apparatus is free from the conventionally encountered problems due to the use of the grinding liquid, such as contamination of the operating environment, difficulty in disposing the used grinding liquid, and high cost for the disposal of the used grinding liquid.

Conventionally, the grinding liquid is supplied to both the grinding point and the point of contact between the grinding wheel and the dresser. Even if the grinding liquid is used for only the dresser, the above-indicated problems more or less remain. In this respect, the use of the cold gas stream for the dresser according to the third preferred form of the cooling method is significant.

The fourth object indicated above may be achieved according to a sixth aspect of this invention, which provides a cooling device for a centerless grinding apparatus including a regulating wheel for rotating a workpiece, a work rest blade cooperating with the regulating wheel to rotatably support the workpiece, a grinding wheel rotated in contact with the workpiece for grinding the workpiece, and a work holder which is interposed between the regulating and grinding wheels, and on one of opposite sides of the workpiece remote from the work rest blade, for holding the workpiece in contact with the workpiece, the cooling device comprising: (a) a cooling gas nozzle provided on the work holder and having an exit end from which a cold gas stream is supplied toward a grinding point between the workpiece and the grinding wheel, the cold gas stream having a temperature lower than an ambient temperature of the centerless grinding apparatus; and (b) a cooling gas supply device for generating the cold gas stream to be delivered to the cooling gas nozzle, such that the cold gas stream delivered to the cooling gas nozzle has a temperature lower than an ambient temperature of the centerless grinding apparatus.

In the cooling device according to the sixth aspect of this invention, the cold gas stream is supplied to the grinding point, so that the heat generated at the grinding point is removed by the cold gas stream, without supplying a grinding liquid to the grinding point.

The elimination of the grinding liquid eliminates covering means for preventing splashing of the grinding liquid, facilitating visual inspection of the grinding condition, and eliminating the cost for the grinding liquid and the cost for replenishing the grinding liquid.

Further, the cooling gas nozzle provided on the work holder reduces the required number of the components of the grinding apparatus, and facilitates the assembling of the components. In addition, the cooling gas nozzle is automatically positioned in place by positioning the work holder relative to the workpiece, without a risk of an interference of the nozzle with the grinding wheel.

In one preferred form of the cooling device according to the sixth aspect of the invention, the cooling gas nozzle has a cooling gas passage formed through a one-piece body of the work holder.

In another preferred form of the cooling device according to the sixth aspect of the invention, the cooling gas supply device includes a compressor for delivering a compressed gas, and a cooler for cooling the compressed gas to provide the cold gas stream.

The fourth object may also be achieved according to a seventh aspect of this invention, which provides a cooling device for a centerless grinding apparatus including a regulating wheel for rotating a workpiece, a work rest blade cooperating with the regulating wheel to rotatably support the workpiece, and a grinding wheel rotated in contact with the workpiece for grinding the workpiece, the cooling device comprising: (a) a cooling gas nozzle having an exit end from which a cold gas stream is supplied toward a grinding point between the workpiece and the grinding wheel, the cold gas stream having a temperature lower than an ambient temperature of the centerless grinding apparatus, the cooling gas nozzle being positioned such that a distance between the exit end and the grinding point is not larger than a diameter of the workpiece; and (b) a cooling gas supply device for generating the cold gas stream to be delivered to the cooling gas nozzle, such that the cooling gas stream delivered to the cooling gas nozzle has a temperature lower than an ambient temperature of the centerless grinding apparatus.

In the cooling device according to the seventh aspect of this invention, the cold gas stream is supplied to the grinding point through the cooling gas nozzle, so that it is not necessary to use a grinding liquid for cooling at the grinding point. Accordingly, the present cooling device has the same advantages as the cooling device according to the sixth aspect of the invention described above.

In addition, the distance between the exit end of the cooling gas nozzle and the grinding point does not exceed the diameter of the workpiece, so that the exit end is located relatively close to the grinding point, making it possible to deliver the cold gas stream at a high velocity, for cooling the workpiece and the grinding wheel at the grinding point with high efficiency, so as to provide an intended cooling effect.

In a preferred form of the cooling device according to the seventh aspect of the invention, the cooling gas supply device includes a compressor for delivering a compressed gas, and a cooler for cooling the compressed gas to provide the cold gas stream.

In a first preferred form of the cooling device according to the sixth or seventh aspect of this invention, the cooling device further comprises: a lubricant nozzle having an exit end and positioned such that a lubricant oil delivered from the exit end is directed toward the grinding point; and a lubricant supply device for delivering the lubricant oil to the lubricant nozzle, whereby the grinding wheel and the workpiece are cooled by the cold gas stream and lubricated by the lubricant oil at the grinding point.

This first preferred form of the cooling device has substantially the same advantages as the first preferred form of the cooling method according to the fourth or fifth aspect of the invention described above.

In a second preferred form of the cooling device according to the sixth or seventh aspect of the invention, the cooling device further comprises a mist spray lubricant nozzle for injecting a lubricant oil into the cold gas stream in the cooling gas nozzle, so as to spray a mist of the lubricant oil toward the grinding point, whereby the grinding wheel and the workpiece are cooled by the cold gas stream and lubricated by the mist of the lubricant at the grinding point.

This second preferred form of the cooling device has substantially the same advantages as the second preferred form of the cooling method according to the fourth or fifth aspect of the invention described above.

In a third preferred form of the cooling device according to the sixth or seventh aspect of the invention, the cooling device further comprises a second cooling gas nozzle for supplying the cold gas stream to a point of contact between the grinding wheel and a dresser which is provided to true and/or dress the grinding wheel.

The third preferred form of the cooling device indicated above has substantially the same advantages as the third preferred form of the cooling method according to the fourth or fifth aspect of the invention described above.

In a fourth preferred form of the cooling device according to the sixth or seventh aspect of this invention, the cooling device further comprises: a hood disposed in a spaced-apart relationship with the grinding wheel, so as to cover a lower portion of a circumference of the grinding wheel; a pump for sucking a fluid in the hood and discharging the fluid into an ambient atmosphere; and a filter for removing solid and liquid particles contained in a stream of the fluid from the hood toward the pump.

In this cooling device, the various solid and liquid particles produced during the grinding operation are removed by the filter. These particles include: metal particles and metal oxide particles which are derived from the workpiece; abrasive grains and binder grains which are derived from the grinding wheel; and particles of a lubricant oil if supplied to the grinding point. Those particles are first collected by the hood, and are carried to the filter, by the gas stream caused under suction by the pump, so that the particles are removed by the filter.

The hood, which is disposed to cover the lower portion of the grinding wheel, does not disturb loading and unloading of the workpiece to and from the centerless grinding apparatus, and permits visual inspection of the grinding condition.

As described above, the temperature of the cold gas stream used in the present invention is required to be lower than the ambient temperature of the machining apparatus such as the centerless grinding apparatus. The "temperature of the cold gas stream" is interpreted to mean the temperature at the inlet end of the cooling gas nozzle. The temperature of the cold gas stream is preferably lower than 0° C., more preferably lower than −10° C., and further preferably lower than −20° C., and most preferably lower than −30° C.

BRIEF DESCRIPTION OF THE DRAWINGS

The above and other objects, features, advantages and technical and industrial significance of this invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
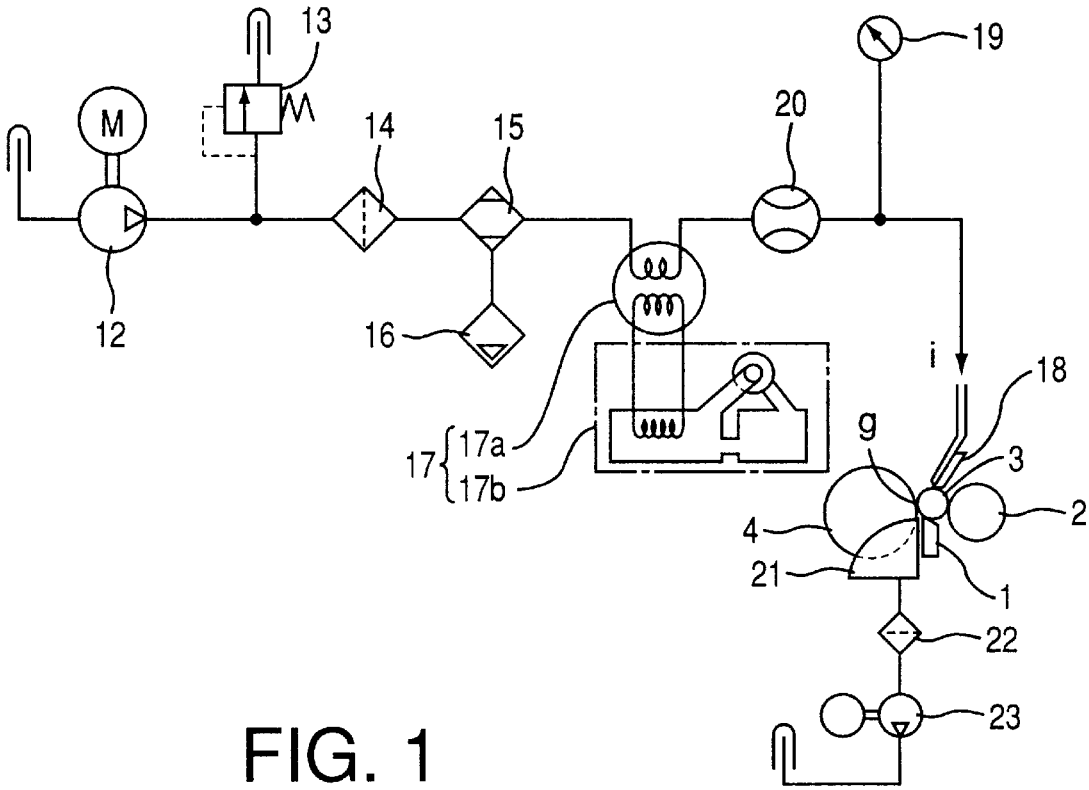
FIG. 1 is a schematic view illustrating a machining apparatus in the form of a centerless grinding apparatus equipped with a cooling air supply device, which is constructed according to one embodiment of the present invention.

Referring first to FIG. 1, there is schematically shown a machining apparatus in the form of a centerless grinding apparatus including a centerless grinder and a cold gas stream supply device in the form of a cold air stream supply device constructed according to one embodiment of this invention.

Figure 7:
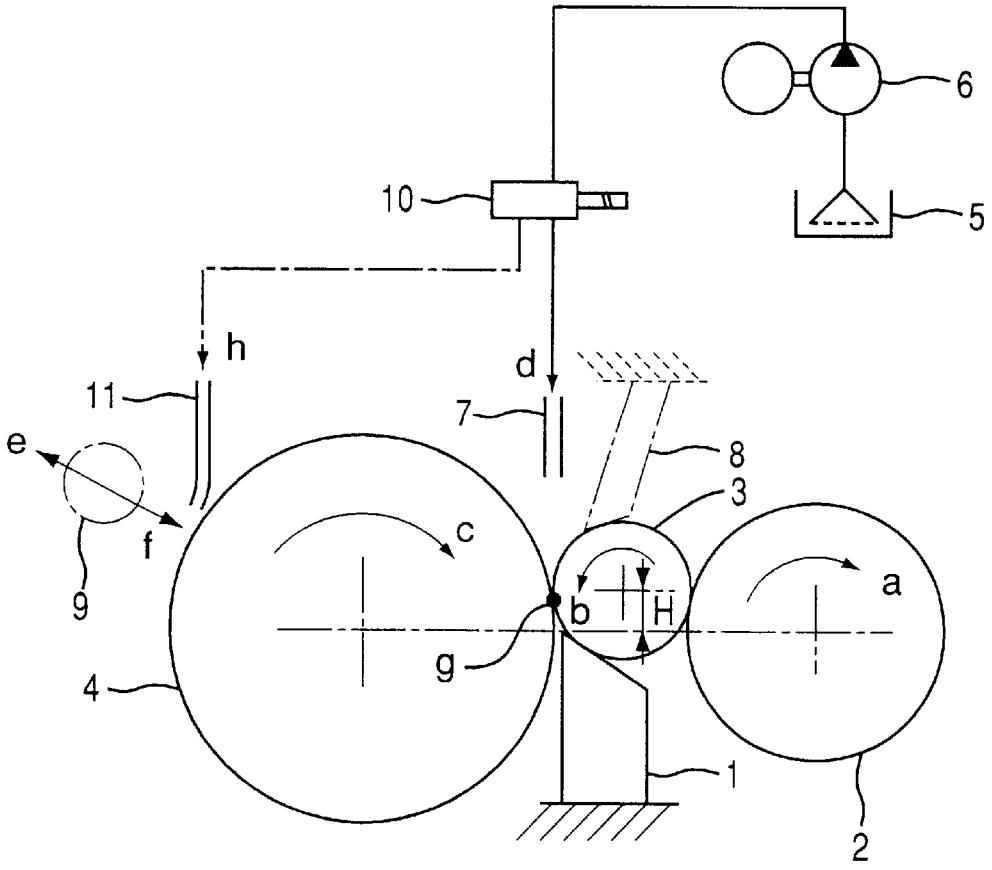
FIG. 7 PRIOR ART
FIG. 7 is a schematic view illustrating a conventional centerless grinding apparatus equipped with a grinding liquid supply device and a dresser.

The centerless grinder includes a work rest blade 1, a regulating wheel 2 and a machining tool in the form of a grinding wheel 4, which cooperate with each other to perform a centerless grinding operation on a workpiece 3, as described above by reference to FIG. 7. The workpiece 3 may be made of a steel or other metallic material.

The cold air stream supply device includes an air pump 12 of compressor type, which is driven by an electric motor M, to pressurize or compress the ambient air. The cold air stream supply device further includes a pressure regulating valve 13 of pressure relief type, an air filter 14, an air drier 15, an automatic drain 16 and an air cooler 17. The pressure of the compressed air delivered from the air pump 12 is automatically regulated by the pressure regulating valve 13. The compressed air having the suitably regulated pressure is cleaned by the air filter 14 and dried by the air drier 15. An aqueous component contained in the compressed air is removed by the air drier 15 and discharged through the automatic drain 16. The clean, dry compressed air is introduced into a heat exchanger 17*a* of the air cooler 17.

The air cooler 17 further includes a refrigeration cycle unit 17*b* for cooling a refrigerant for thereby lowering the temperature of the compressed air flowing through the heat exchanger 17*a*. The air cooler 17 is adapted to cool the compressed air to a desired temperature, for instance, about −30° C. Thus, a cold air stream is generated by the pump 12 and the air cooler 17. The cold air stream is fed into a cooling air nozzle, which will be described.

The temperature to which the compressed air is cooled by the cooler 17 is suitably determined depending upon the various grinding conditions of the centerless grinder. However, the principle of the present invention can be practiced, provided the temperature of the cold air stream as measured at the inlet end of the cooling air nozzle is lower than the ambient temperature of the centerless grinder. The temperature of the cold air stream at the inlet end of the cooling air nozzle is preferably lower than 0° C., more preferably lower than −10° C., further preferably −20° C., and most preferably lower than −30° C.

The centerless grinder of the present centerless grinding apparatus includes a work holder 18 which cooperates with the work rest blade 1 to hold the workpiece 3 during a grinding operation. The work holder 18 also functions as a cooling gas nozzle, more precisely, the cooling air nozzle indicated above, through which the cold air stream or blast coming from the air cooler 17 (heat exchanger 17*a*) as indicated at "i" in FIG. 1 is delivered toward the machining point, that is, toward the grinding point g between the workpiece 3 and the grinding wheel 4, as clearly shown in the enlarged view of FIG. 2. Thus, the cold air stream is supplied to the grinding point g of the centerless grinder, from the cold air stream supply device which utilizes the work holder 18 of the centerless grinder as the cooling air nozzle. The work holder 18 will be described in detail by reference to FIG. 2.

Between the heat exchanger 17*a* and the cooling air nozzle 18 (work holder), there are provided an air pressure sensor 19 for detecting the pressure of the cold compressed air, and an air flow meter 20 for detecting a rate of flow of the cold compressed air.

While the cold air stream supply device in the present embodiment is adapted to produce a cold air stream (indicated at "i" in FIGS. 1 and 2) by cleaning, drying and cooling the compressed ambient air, the centerless grinding apparatus may employ a cold gas stream supply device which provides a stream or blast of a cold gas other than the ambient air. For instance, the cold gas stream supply device may be adapted to produce a cold gas stream by vaporizing a liquid oxygen. The cold gas is preferably an oxidizing gas rather than a reducing gas.

A hood 21 is disposed in a spaced-apart relationship with the grinding wheel 4, so as to cover a lower circumferential portion of the grinding wheel 4. The air or gas containing solid particles generated during the grinding operation is sucked into the hood 21, under suction created by an exhaust pump 23 which is connected to the hood 21 through an air filter 22. In this arrangement, the solid particles are collected by the air filter 22, and the thus cleaned air is discharged into the ambient atmosphere or air through the exhaust pump 23. The solid particles include metal particles and metal oxide particles removed from the workpiece 3, and abrasive grains and binder grains removed from the grinding wheel 4. The present arrangement which does not use a grinding liquid supply device, which is relatively simple in construction and economical to manufacture, is effective to maintain clean working environment of the centerless grinding apparatus.

Figure 2:
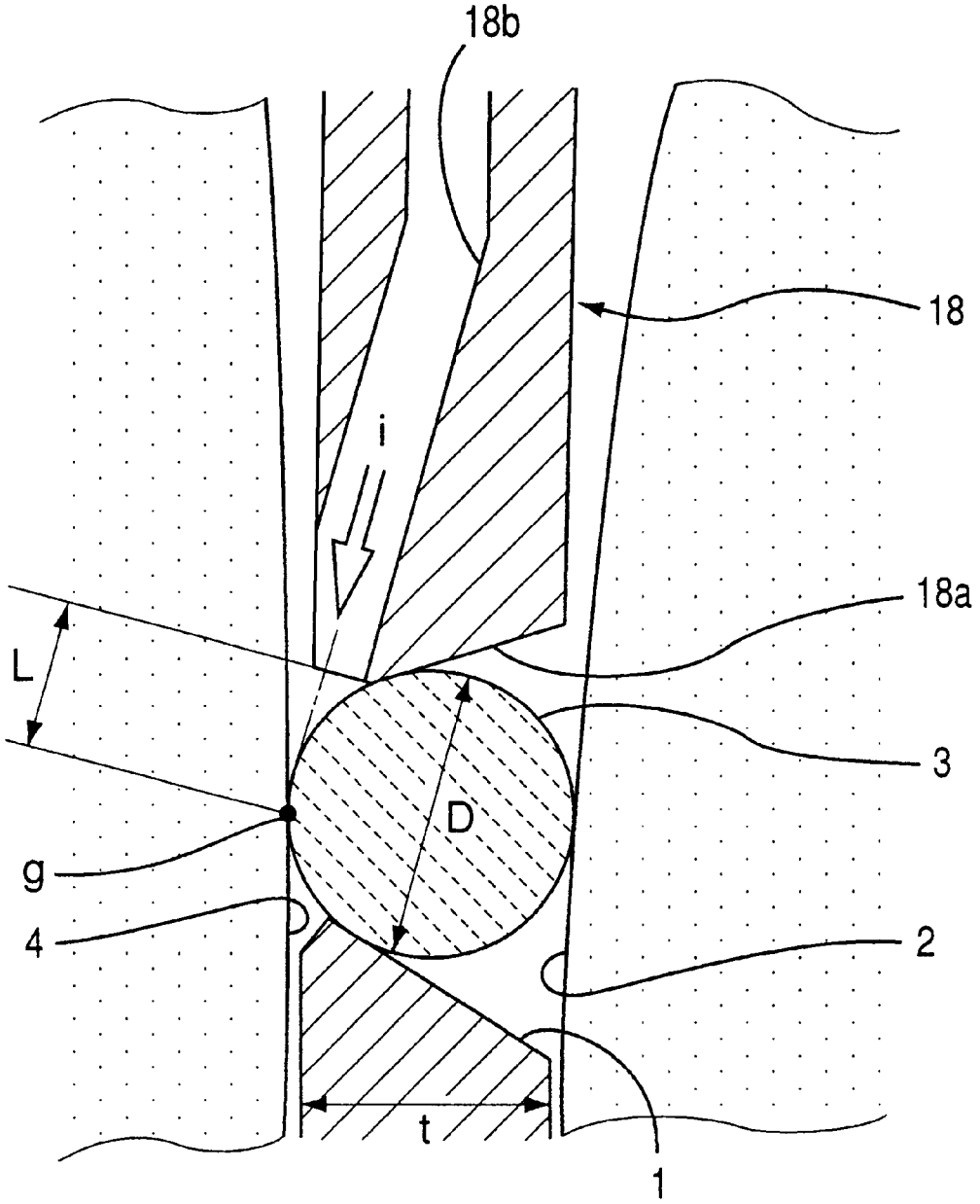
FIG. 2 is a fragmentary enlarged view in cross section of a portion of the centerless grinder of FIG. 1, in the vicinity of the workpiece, which portion includes a work holder which also functions as a cooling air nozzle.

Reference is now made to the enlarged view of FIG. 2, which shows a portion of the centerless grinder near the workpiece 3, in cross section taken in a plane perpendicular to the axis of rotation of the workpiece 3. The work holder 18 has a lower work holding surface 18*a* for frictional contact with the circumferential surface of the workpiece 3. The position of the point of contact of the work holding surface 18*a* with the workpiece 3 has been described above with respect to the work holder 8 of the conventional centerless grinding apparatus of FIG. 7. Unlike the work holder 8, the work holder 18 has a cooling air passage 18*b* formed therethrough, so that the cold air ejected from the exit end of the passage 18*b*, toward the grinding point g between the workpiece 3 and the grinding wheel 4, as indicated at "i" in FIG. 2. Thus, the cold air gas stream or blast in the form of the cold air stream is supplied to the grinding point g.

The cold air stream supply device constructed as described above has the following advantages:

(a) relatively small number of components required;

(b) relatively easy arrangement of the components in a relatively narrow space in the centerless grinding apparatus;

(c) easy positioning of the cooling air nozzle 18 (work holder) in a relatively narrow space defined by the workpiece 3 and the regulating and grinding wheels 2, 4; and (d) easy orientation of the cooling air nozzle 18 such that the exit end of the cooling air passage 18*b* is located close to the grinding point g.

Although the work holder 18 is a one-piece structure having the cooling air passage 18*b* formed therethrough, a separately formed cooling air nozzle having a cooling air passage may be fixed to the work holder not having the cooling air passage 18*b*, such that the nozzle and the work holder constitute a comparatively compact assembly functioning as the work holder and the cooling air nozzle.

Where the diameter of the workpiece 3 is relatively small relative to the diameters of the regulating and grinding wheels 2, 4, the space between the regulating and grinding wheels 2, 4 is relatively narrow. Accordingly, it is difficult to design a separate cooling air nozzle that can be easily disposed in this relatively narrow space, together with the work holder which does not have the cooling air passage. However, the work holder 18 used in the present embodiment, which has the cooling air passage 18*b* formed therethrough, can be easily positioned in the above-indicated narrow space.

The work holder 18 is usually positioned such that the work holding surface 18*a* is in contact with the workpiece 3, with a suitable contact pressure and such that the cooling air passage 18*b* is oriented so as to provide the cold air stream toward the grinding point g. This positioning is considerably easier than where the separate work holder and cooling air nozzle are positioned independently of each other.

In particular, it is noted that the exit end of the cooling air passage 18*b* is partly defined by, and located close to the part of the work holding surface 18*a* at which the work holder 18 contacts the workpiece 3. This arrangement makes it easier to position the exit end of the cooling air nozzle (passage 18*b*) adjacent to the grinding point g.

In the present first embodiment in which the member 18 functions not only as the cooling air nozzle but also as the work holder, a distance L between the exit end of the passage 18*b* and the grinding point g is smaller than a diameter D of the workpiece 3, since the work holding surface 18*a* is in contact with the circumferential surface of the workpiece.

However, the work holder 18 may be positioned such that the work holding surface 18*a* is spaced apart from the workpiece 3. In other words, the work holder 18 is not essential, and only a cooling air nozzle (which does not have a work holding function) may be provided adjacent to the workpiece 3. This cooling air nozzle is shown at 18' in FIG. 3, which shows a second embodiment of this invention. The cooling air nozzle 18' is located apart from the circumferential surface of the workpiece 3, such that the exit end of the cooling air nozzle 18' is spaced from the grinding point g by a distance L.

A dimension "t" of the work rest blade 1 in the diametric direction of the workpiece 3 varies with the diameter D of a portion of the workpiece 3 to be ground. Similarly, the center height "H" (FIG. 7) of the workpiece 3 relative to the regulating and grinding wheels 2, 4 varies with the diameter D of the workpiece 3. Further, the positional relationship between the two wheels 2, 4 varies with the diameter D of the workpiece 3. With these facts taken into account, the distance L of the cooling air nozzle 18' is desirably not larger than the diameter D of the workpiece 3. It is desired that the cold air ejected from the exit end of the cooling air passage 18*b* of the cooling air nozzle 18' does not flow to the grinding point g, over a distance exceeding the diameter D of the workpiece 3. Thus, the desired upper limit of the distance L is determined so as to prevent diffusion or scattering of the cold air during its flow to the grinding point g, so that the cold air stream which has reached the grinding point g has sufficiently high pressure and flow velocity for effectively cooling the workpiece 3 and grinding wheel 4 at the grinding point g.

Figure 3:
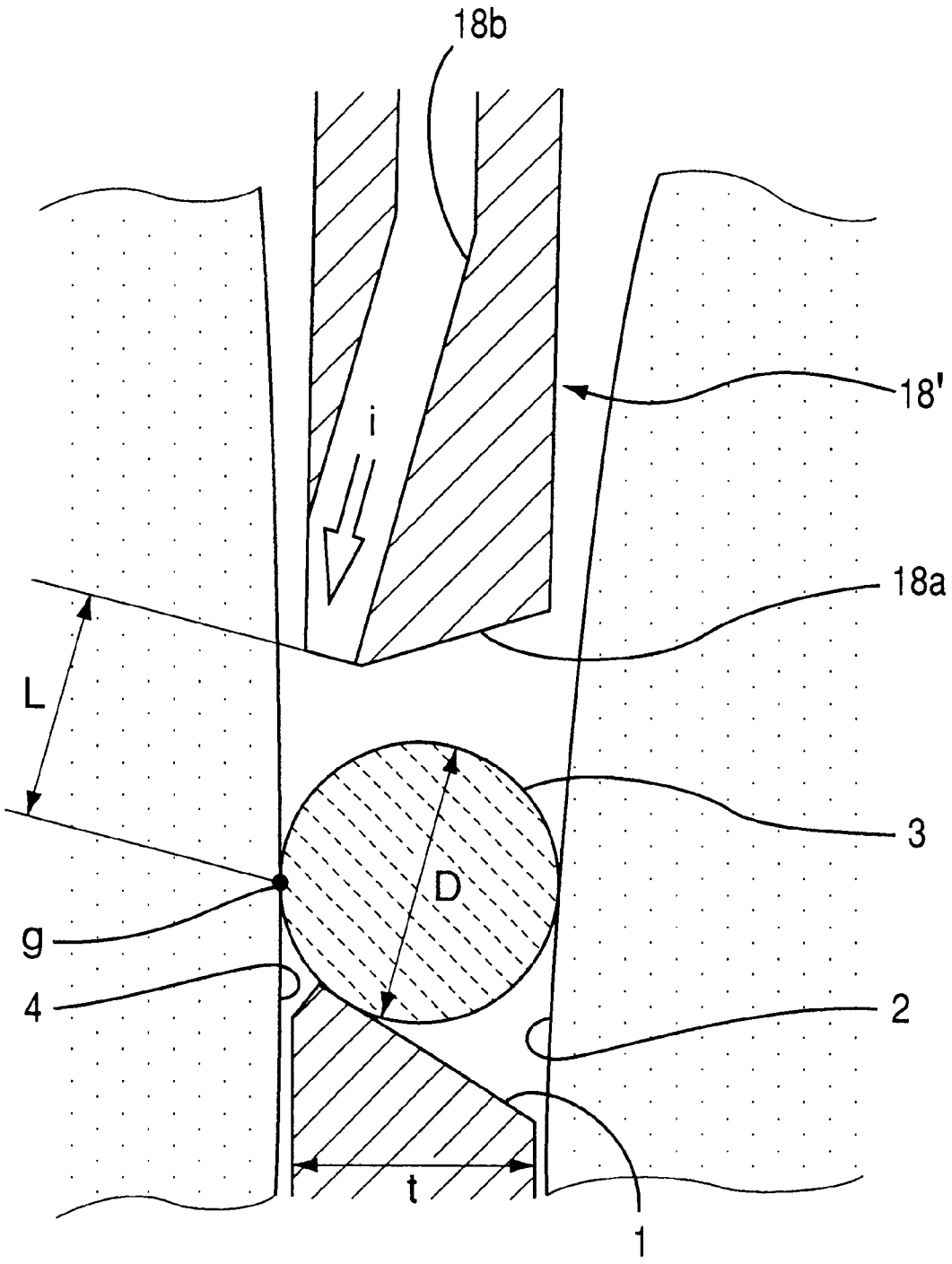
FIG. 3 is a view corresponding to that of FIG. 2, showing a second embodiment of the invention wherein a cooling air nozzle not functioning as a work holder is positioned apart from the workpiece.

From the standpoint of the cooling efficiency, there is not a lower limit of the distance L of the work holder 18 of FIG. 2 and the cooling air nozzle 18' of FIG. 3. Practically, however, the work holder 18 and the cooling air nozzle 18' should not interfere with the grinding wheel 4. In this respect, the lower limit of the distance L should be properly set so as to avoid the above-indicated interference, while taking into account dimensional and assembling or positioning error tolerances of the components and unavoidable thermal strains and mechanical vibrations of the components.

For grinding the workpieces having different diameters, the centerless grinder is adapted such that the relative position of the work rest blade 1, regulating and grinding wheels 2, 4 and work holder 18 (FIG. 2) or cooling air nozzle 18' (FIG. 3) can be adjusted. The present inventors found it necessary to determine the distance L (between the grinding point g and the exit end of the cooling air passage 18*b*) depending upon the diameter of a portion of the workpiece 3 to be ground.

However, the work holder 18 or cooling air nozzle 18' may be stationary at a predetermined position at which the distance L for the largest diameter of the workpiece that can be ground by the centerless grinder in question is not larger than that largest diameter. In this case, too, the principle of the present invention is satisfied.

To determine the distance L for the maximum diameter of the workpiece, an area (along the circumference of the workpiece 3) in which the grinding point g may be located for the workpiece 3 having the largest diameter D is determined. A distance between the exit end of the cooling air passage 18*b* and one of the opposite ends of the above-indicated area which is nearer to the exit end in the circumferential direction of the workpiece 3 is measured and determined as the distance L.

Figure 4:
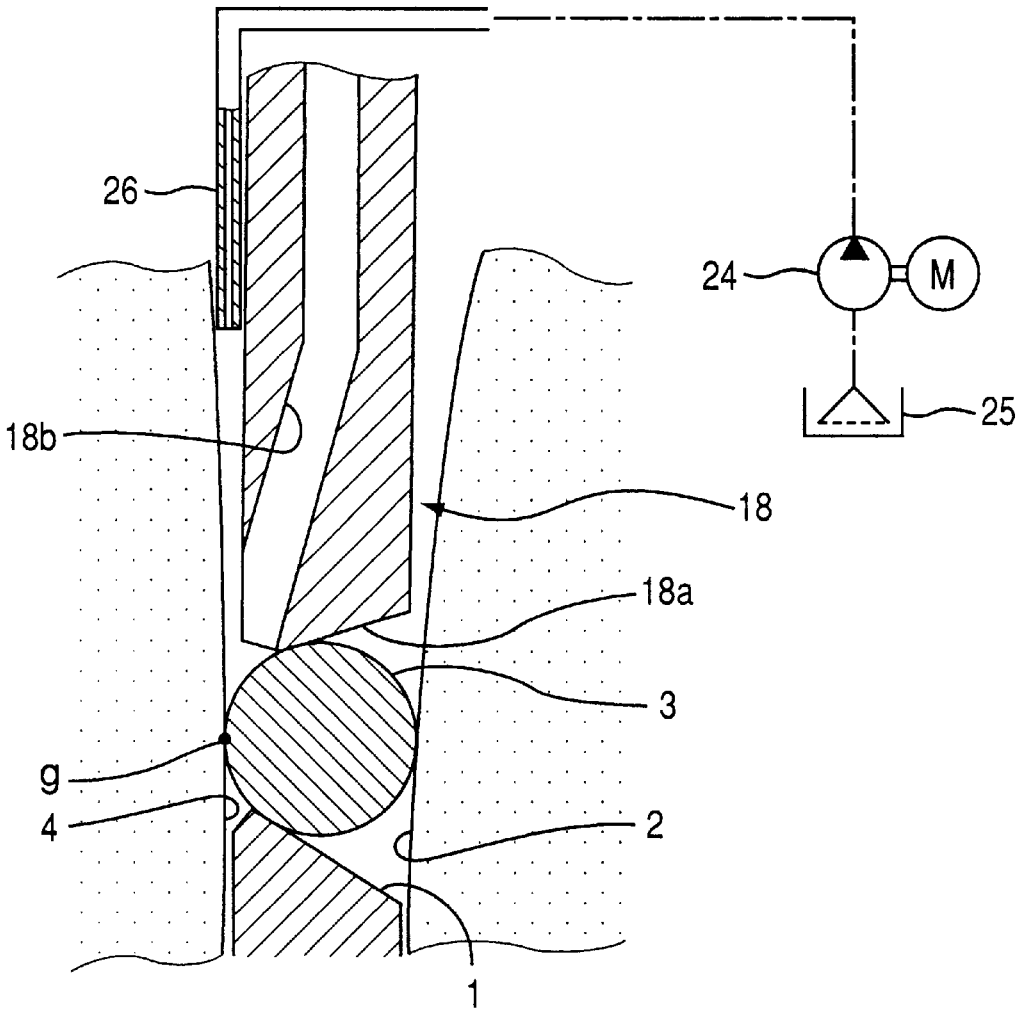
FIG. 4 is a view schematically showing a third embodiment of the invention wherein a normal lubricant nozzle is provided together with the work holder shown in FIG. 2.

Referring to FIG. 4, there will be described a third embodiment of the present invention, wherein a lubricant supply device is provided in addition to the work holder 18 of FIG. 2 which also serves as the cooling air nozzle. The lubricant supply device includes an oil pump 24, and a lubricant tank 25 in which there is stored a lubricant of vegetable oil type (hereinafter referred to as "lubricant oil"). The lubricant supply device further includes a normal lubricant nozzle 26. The lubricant oil in the tank 25 is pressurized by the oil pump 24, and the pressurized lubricant oil is delivered to the normal lubricant nozzle 26.

In the third embodiment of FIG. 4, The pressurized lubricant oil delivered from the oil pump 24 is ejected toward the grinding point g, from the normal lubricant nozzle 26. This nozzle 26 may be positioned adjacent to the work holder 18, or fixed to the work holder 18 with a predetermined positional relationship therebetween. The lubricant nozzle 26 may be provided together with the cooling air nozzle 18' of FIG. 3 not functioning as a work holder.

A fourth embodiment of the present invention will be described by reference to FIG. 5. This embodiment uses a work holder 18" which has a cooling air passage 18*b* having a restricted or throttle portion 18*c*. The work holder 18" further has a mist spray lubricant nozzle 27, which is open in the surface of the throttle portion 18*c*. The lubricant oil coming from the oil pump 24 is injected from the mist spray lubricant nozzle 27 into the compressed cold air flowing through the cooling air passage 18*b*. As a result, a mist of the lubricant oil is sprayed toward the grinding point g, so that the workpiece 3 and the grinding wheel 4 are coated with films of the lubricant oil. The mist consists of fine particles of the lubricant oil. The size of the lubricant particles of the mist is considerably smaller than lubricant droplets which would drip from a nozzle by gravity, at a substantially zero pressure of injection.

Figure 5:
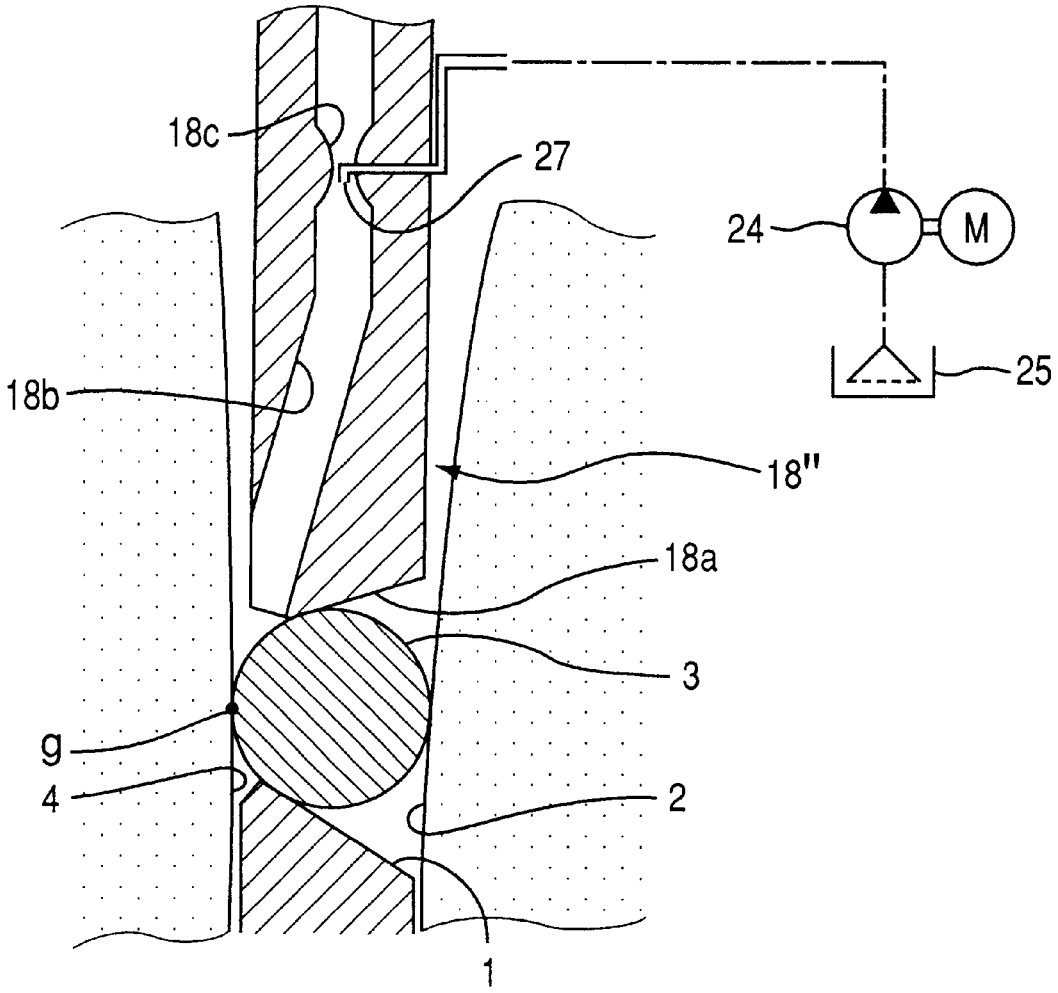
FIG. 5 is a view schematically showing a fourth embodiment of the invention wherein the work holder also functioning as a cooling air nozzle has a mist spray lubricant nozzle.

In the fourth and fifth embodiments of FIGS. 4 and 5, the lubricant supply device capable of supplying the lubricant oil to the grinding point g is effective to prevent burning and cracking of the ground surface of the workpiece 3, and to assure a mirror finish of the ground surface.

The lubricant oil supplied to the grinding point g is also collected by the hood 21 and the air filter 22, under suction of the exhaust pump 23. The hood 21, air filter 22 and exhaust pump 23 have been described above with respect to the first embodiment of FIGS. 1 and 2.

Figure 6:
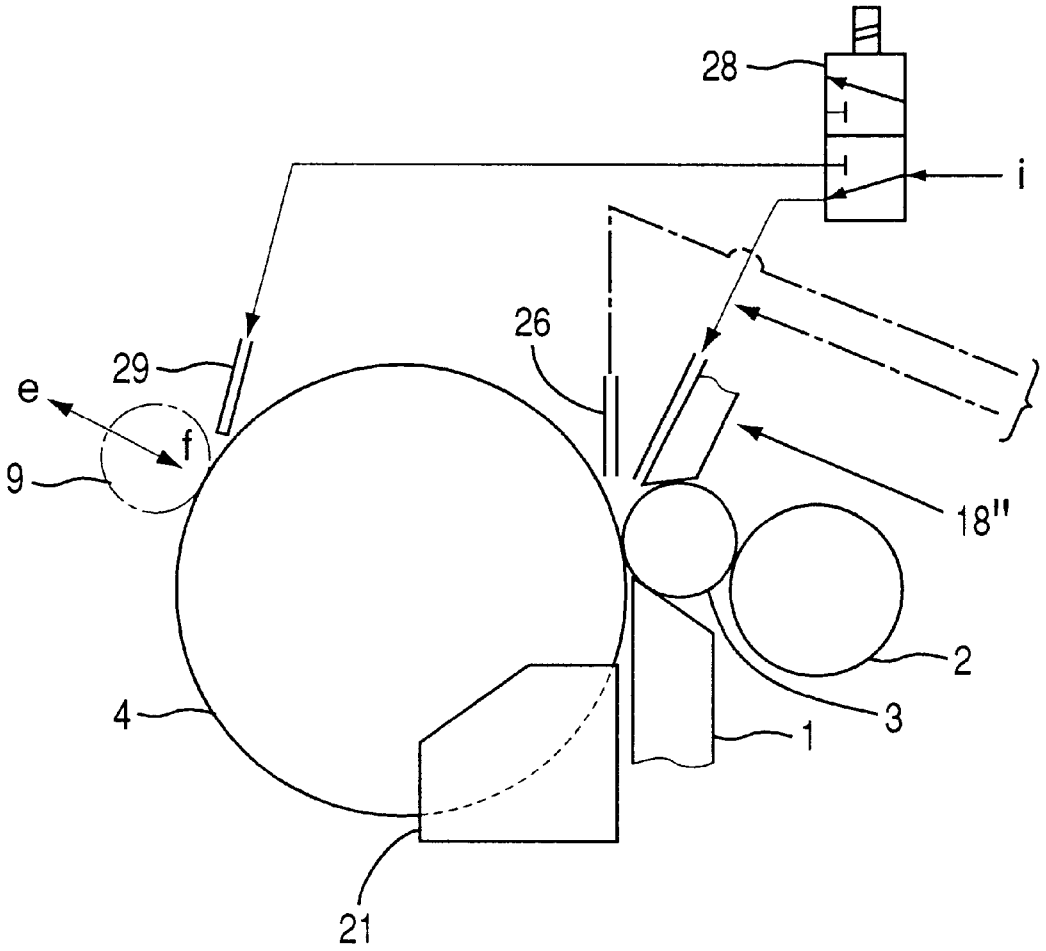
FIG. 6 is a view showing a fifth embodiment of the invention.

Referring next to FIG. 6, there will be described a fifth embodiment of the present invention, which is a modification of the third or fourth embodiment of FIG. 4 or 5 in which either the normal lubricant nozzle 26 or the modified work holder 18" is provided. In FIG. 6, both the normal lubricant nozzle 26 and the work holder 18" are shown. However, where the nozzle 26 is provided, the tool holder 18 of FIG. 2 is provided, as in the third embodiment of FIG. 4. Where the tool holder 18" of FIG. 5 is provided, the nozzle 26 is not provided.

In the fifth embodiment of FIG. 6, the centerless grinding apparatus includes a dresser 9 of rotary type, which is movable between the retracted and advanced positions as indicated arrows "e" and "f". In the advanced position, the dresser 9 is operated to achieve a truing or dressing operation, as described above with respect to the conventional centerless grinding apparatus by reference to FIG. 7.

The fifth embodiment of FIG. 6 is characterized by the cold air stream supply device which includes a second cooling air nozzle 29 located adjacent to the dresser 29, and a directional control valve 28 which receives the cold gas in the form of the cold compressed air indicated at "i" in FIG. 6, which is delivered from the air cooler 17, as described above with respect to the first embodiment of FIGS. 1 and 2. When the dresser 9 is brought into its advanced position, the directional control valve 28 is switched to direct the cold compressed air to the second cooling air nozzle 29, rather than to the first cooling air nozzle in the form of the cooling air passage 18*b* formed in the work holder 18 or 18". As a result, the cold air stream or blast is supplied to the point of contact between the dresser 9 and the grinding wheel 4, for reducing or minimizing the temperature rise due to the heat generation during the truing or dressing operation. The cold air stream is effective to minimize the temperature rise at the dressing or truing point as well as the temperature rise at the grinding point g.

While the presently preferred embodiments of this invention have been described above in detail by reference to the accompanying drawings, it is to be understood that the invention is not limited to the details of the illustrated embodiments, but may be embodied with various changes, modifications and improvements, which may occur to those skilled in the art, without departing from the spirit and scope of the invention defining in the following claims.

What is claimed is:

1. A machining apparatus for machining a workpiece with a machining tool, comprising:

a cold gas stream supply device including a cooling gas nozzle through which a cold gas stream having a temperature lower than an ambient temperature of the machining apparatus is supplied to a machining point for cooling at said machining point;

a regulating wheel for rotating the workpiece;

a work rest blade disposed between said regulating wheel and a grinding wheel as said machining tool, said work rest blade cooperating with said regulating wheel to support the workplace such that the workpiece is rotated by frictional contact with said regulating wheel, said grinding wheel being rotated in contact with the workpiece to grind the workpiece; and a work holder for holding the workpiece, said work holder being interposed between said regulating wheel and said grinding wheel and being located on one of opposite sides of the workpiece remote from said work rest blade, said cooling gas nozzle being provided on said work holder so that said cold gas stream is delivered from said cooling gas nozzle toward a grinding point as said machining point between said grinding wheel and the workpiece.

2. A machining apparatus according to claim 1, wherein said cooling gas nozzle is a first cooling gas nozzle, and including a dresser for achieving truing and dressing operations to said grinding wheel, said cold gas stream supply device further including a second cooling gas nozzle located adjacent to said dresser so that said cold gas stream is delivered from said second cooling gas nozzle toward a point of contact between said grinding wheel and said dresser.

3. A process of machining a workpiece by using the machining apparatus defined in claim 2, comprising:

supplying said cold gas stream to said grinding point through said first gas nozzle; and supplying said cold gas stream to said point of contact between said grinding wheel and said dresser through said second cooling gas nozzle when said grinding wheel is subjected to at least one of said truing operation and said dressing operation by said dresser.

4. A process of machining a workpiece by using the machining apparatus defined in claim 1, comprising:

positioning said work holder such that an exit end of said cooling gas nozzle is located adjacent to said grinding point and such that said work holder is prevented from contacting said grinding wheel; and supplying said cold gas stream from said exit end of said cooling gas nozzle to said grinding point.

5. A machining apparatus for machining a workpiece with a machining tool, comprising:

a cold gas stream supply device including a cooling gas nozzle through which a cold gas stream having a temperature lower than an ambient temperature of the machining apparatus is supplied to a machining point for cooling at said machining point;

a regulating wheel for rotating the workpiece;

a work rest blade disposed between said regulating wheel and a grinding wheel as said machining tool, said work rest blade cooperating with said regulating wheel to support the workpiece such that the workpiece is rotated by frictional contact with said regulating wheel, said grinding wheel being rotated in contact with the workpiece to grind the workpiece; and a work bolder for holding the workpiece, said work holder being interposed between said regulating wheel and said grinding wheel and being located on one of opposite sides of the workpiece remote from said work rest blade, said cooling gas nozzle being fixed to said work holder to provide an assembly and said cold gas stream being delivered from said cooling gas nozzle toward a grinding point as said machining point between said grinding wheel and the workpiece.

6. A machining apparatus according to claim 5, wherein said cooling gas nozzle is a first cooling gas nozzle, and including a dresser for achieving truing and dressing operations to said grinding wheel, said cold gas stream supply device further including a second cooling gas nozzle located adjacent to said dresser so that said cold gas stream is delivered from said second cooling gas nozzle toward a point of contact between said grinding wheel and said dresser.

7. A process of machining a workpiece by using the machining apparatus defined in claim 6, comprising:

supplying said cold gas stream to said grinding point through said first gas nozzle, and supplying said cold gas stream to said point of contact between said grinding wheel and said dresser through said second cooling gas nozzle when said grinding wheel is subjected to at least one of said truing operation and said dressing operation by said dresser.

8. A process of machining a workpiece by using the machining apparatus defined in claim 5, comprising:

positioning said work holder such that an exit end of said cooling gas nozzle is located adjacent to said grinding point and such that said work holder is prevented from contacting said grinding wheel; and supplying said cold gas stream from said exit end of said cooling gas nozzle to said grinding point.

9. A machining apparatus for machining a workpiece with a machining tool, comprising:

a cold gas stream supply device including a cooling gas nozzle through which a cold gas stream having a temperature lower than an ambient temperature of the machining apparatus is supplied to a machining point for cooling at said machining point;

a regulating wheel for rotating the workpiece;

a work rest blade disposed between said regulating wheel and a grinding wheel as said machining tool, said work rest blade cooperating with said regulating wheel to support the workpiece such that the workpiece is rotated by frictional contact with said regulating wheel, said grinding wheel being rotated in contact with the workpiece to grind the workpiece; and a work holder for holding the workpiece, said work holder being interposed between said regulating wheel and said grinding wheel and being located on one of opposite sides of the workpiece remote from said work rest blade, said cooling gas nozzle being incorporated in said work holder such that a cooling gas passage is formed through said work holder, with said cold gas stream being delivered from said cooling gas nozzle toward a grinding point as said machining point between said grinding wheel and the workpiece.

10. A machining apparatus according to claim 9, wherein said cooling gas nozzle is a first cooling gas nozzle, and including a dresser for achieving truing and dressing operations to said grinding wheel, said cold gas stream supply device further including a second cooling gas nozzle located adjacent to said dresser so that said cold gas stream is delivered from said second cooling gas nozzle toward a point of contact between said grinding wheel and said dresser.

11. A process of machining a workpiece by using the machining apparatus defined in claim 10, comprising:

supplying said cold gas stream to said grinding point through said first gas nozzle; and supplying said cold gas stream to said point of contact between said grinding wheel and said dresser through said second cooling gas nozzle when said grinding wheel is subjected to at least one of said truing operation and said dressing operation by said dresser.

12. A machining apparatus according to claim 9, wherein said cooling gas passage has an exit end from which said cold gas stream is supplied to said machining point, said exit end being partially defined by and located adjacent to a work holding surface of said work holder at which said work holder is contactable with the workpiece.

13. A process of machining a workpiece by using the machining apparatus defined in claim 9, comprising:

positioning said work holder such that an exit end of said cooling gas nozzle is located adjacent to said grinding point and such that said work holder is prevented from contacting said grinding wheel; and supplying said cold gas stream from said exit end of said cooling gas nozzle to said grinding point.

14. A machining apparatus for machining a workpiece with a machining tool, comprising.

a work holder for holding the workpiece;

a cold gas stream supply device including a cooling gas nozzle through which a cold gas stream having a temperature lower than an ambient temperature of the machining apparatus is supplied to a machining point for cooling at said machining point, said cooling gas nozzle being provided on said work holder; and a lubricant supply device including a lubricant nozzle which is open in a cooling gas passage of said cooling gas nozzle to supply a lubricant oil from said lubricant nozzle into said cold gas stream flowing through said cooling gas passage.

15. A process of machining a workpiece by using the machining apparatus defined in claim 14, comprising:

supplying said cold gas stream to said machining point through said cooling gas nozzle; and supplying said lubricant oil into said cold gas stream in said cooling gas passage to spray a mist of the lubricant oil toward said machining point.

16. A machining apparatus for machining a workpiece with a machining tool, comprising:

a work holder for holding the workpiece;

a cold gas stream supply device including a cooling gas nozzle through which a cold gas stream having a temperature lower than an ambient temperature of the machining apparatus is supplied to a machining point for cooling at said machining point; and a lubricant supply device including a lubricant nozzle which is open in a cooling gas passage of said cooling gas nozzle to supply a lubricant oil from said lubricant nozzle into said cold gas stream flowing through said cooling gas passage, said cooling gas nozzle being fixed to said work holder to provide an assembly.

17. A process of machining a workpiece by using the machining apparatus defined in claim 16, comprising:

supplying said cold gas stream to said machining point through said cooling gas nozzle; and supplying the lubricant oil into said cold gas stream in said cooling gas passage to spray a mist of the lubricant oil toward said machining point.

18. A machining apparatus for machining a workpiece with a machining tool, comprising:

a work holder for holding the workpiece, a cold gas stream supply device including a cooling gas nozzle through which a cold gas stream having a temperature lower than an ambient temperature of the machining apparatus is supplied to a machining point for cooling at said machining point; and a lubricant supply device including a lubricant nozzle which is open in a cooling gas passage of said cooling gas nozzle to supply a lubricant oil from said lubricant nozzle into said cold gas stream flowing through said cooling gas passage, said cooling gas nozzle being incorporated in said work holder such that a cooling gas passage is formed through said work holder.

19. A process of machining a workpiece by using the machining apparatus defined in claim 18, comprising:

supplying said cold gas stream to said machining point through said cooling gas nozzle; and supplying the lubricant oil into said cold gas stream in said cooling gas passage to spray a mist of the lubricant oil toward said machining point.

* * * * *